US009417035B2

(12) United States Patent
Poirier et al.

(10) Patent No.: US 9,417,035 B2
(45) Date of Patent: Aug. 16, 2016

(54) BLANK FIRING LASER ATTACHMENT

(71) Applicant: NORTHERN OPTOTRONICS INC., Cambridge (CA)

(72) Inventors: Jean Marc Poirier, Cameron (CA); Bradley Marc Poirier, Cambridge (CA)

(73) Assignee: NORTHERN OPTOTRONICS INC., Cambridge (CA)

( * ) Notice: Subject to any disclaimer, the term of this patent is extended or adjusted under 35 U.S.C. 154(b) by 0 days.

(21) Appl. No.: 13/906,926

(22) Filed: May 31, 2013

(65) Prior Publication Data

US 2013/0319216 A1 Dec. 5, 2013

Related U.S. Application Data

(60) Provisional application No. 61/654,177, filed on Jun. 1, 2012.

(51) Int. Cl.

| | |
|---|---|
| ***F41A 33/02*** | (2006.01) |
| ***F41G 3/26*** | (2006.01) |
| ***F41G 1/35*** | (2006.01) |
| ***F41A 9/38*** | (2006.01) |
| ***F41A 21/32*** | (2006.01) |

(52) U.S. Cl.

CPC ... *F41G 1/35* (2013.01); *F41A 9/38* (2013.01); *F41A 21/32* (2013.01); *F41A 33/02* (2013.01); *F41G 3/26* (2013.01)

(58) Field of Classification Search

CPC ..... F41A 33/02; F41G 3/2655

USPC ..... 42/114, 116, 117; 434/21, 22, 16

See application file for complete search history.

(56) References Cited

U.S. PATENT DOCUMENTS

| | | | | |
|---|---|---|---|---|
| 3,938,262 | A | 2/1976 | Dye et al. | |
| 4,678,437 | A * | 7/1987 | Scott | F41A 33/02 434/21 |
| 4,948,371 | A * | 8/1990 | Hall | 434/21 |
| 4,983,123 | A * | 1/1991 | Scott et al. | 434/21 |
| 5,842,300 | A * | 12/1998 | Cheshelski et al. | 42/116 |
| 5,947,738 | A * | 9/1999 | Muehle et al. | 434/16 |
| 6,322,365 | B1 * | 11/2001 | Shechter | F41A 33/02 434/19 |
| 6,579,098 | B2 * | 6/2003 | Shechter | 434/21 |
| 6,638,070 | B1 * | 10/2003 | Healy et al. | 434/22 |
| 6,935,864 | B2 * | 8/2005 | Shechter et al. | 434/19 |
| 7,036,260 | B2 * | 5/2006 | Gee | 42/76.01 |
| 7,306,462 | B2 * | 12/2007 | Metcalfe et al. | 434/18 |
| 7,329,127 | B2 * | 2/2008 | Kendir et al. | 434/21 |
| 8,568,143 | B2 * | 10/2013 | Uhr | 434/16 |
| 2006/0265929 | A1 * | 11/2006 | Haney | 42/116 |
| 2013/0273504 | A1 * | 10/2013 | Carter | 434/19 |
| 2013/0337415 | A1 * | 12/2013 | Huet | F41G 3/26 434/21 |

* cited by examiner

*Primary Examiner* — Reginald Tillman, Jr.

(74) *Attorney, Agent, or Firm* — Gowling WLG (Canada) LLP; Jeffrey W. Wong

(57) ABSTRACT

The disclosure is directed at a method and system for improving situational awareness and accuracy of a user with a firearm. The system includes a blank firing laser attachment which is mounted to an end of the firearm and emits a laser when the trigger is pulled.

11 Claims, 12 Drawing Sheets

BLANK FIRING LASER ATTACHMENT

RELATED APPLICATIONS

This application claims the benefit of U.S. Provisional application No. 61/654,177 filed Jun. 1, 2012, which is hereby incorporated by reference.

FIELD OF THE DISCLOSURE

The disclosure is generally directed at lasers and more specifically at a blank firing laser attachment.

BACKGROUND OF THE DISCLOSURE

The use of weapons, such as firearms, has been around for a long time. Firearms are typically used by law enforcement individuals, military personnel or hunters. When using these firearms, training of personnel in the use of firearms in these environments is important as a wayward shot may result in the injury of an innocent bystander or a waste of ammunition.

In order to practice one's accuracy, firearm owners may typically go to a shooting range whereby they can fire live ammunition at either standing or moving targets. However, the use of live ammunition may be quite expensive over the course of time.

Therefore, there is provided a blank firing laser attachment for use with firearms which assist firearm owners to improve their accuracy.

SUMMARY

In one aspect, there is provided a blank firing laser attachment apparatus for use with a firearm including a laser module for producing a laser output, wherein the laser output is in axial alignment with a barrel housing of the firearm; a trigger actuation module comprising a switching mechanism for sensing when a blank cartridge has been discharged by a pulling of a trigger of the firearm; an electronic module for modulating the laser output; a processor for activating the laser output when the trigger is pulled; and a barrel end housing module for mounting the blank firing laser attachment apparatus to the barrel housing.

In another aspect, there is provided a method for shooting a blank firing laser attachment in use with a firearm including sensing actuation of a discharged blank cartridge via a trigger of the firearm; emitting a laser output after sensing actuation of the trigger; and modulating the laser output.

Other aspects and features of the present disclosure will become apparent to those ordinarily skilled in the art upon review of the following description of specific embodiments in conjunction with the accompanying figures.

BRIEF DESCRIPTION OF THE DRAWINGS

The invention will now be described in detail, with reference to the accompanying drawings of preferred and exemplary embodiments, in which.

DETAILED DESCRIPTION

The disclosure is directed at a novel method and system for improving accuracy of individuals using firearms, such as guns, pistols, rifles and the like. In one embodiment, the system includes a blank firing laser attachment (BFLA) for use with a firearm where the BFLA is mounted to or integrated with the firearm. In one embodiment, the BFLA is for use in weapons accuracy training whereby the BFLA triggers a laser which may be used to interact with a sensor (associated with a target) to determine if a user of the weapon has hit the target. For instance, the sensor may be located within a safety vest of an individual who may be in motion or the sensor may be located within a stationary target. This also provides a safe way for users of these firearms to practice or improve their accuracy using real-life scenarios without the need for live ammunition or risking injury.

In another embodiment, the BLFA is able to provide the necessary recoil action to mimic or replicate the response from the firearm as if the person firing the firearm is actually using live ammunition to provide a more realistic experience.

Figure 1:
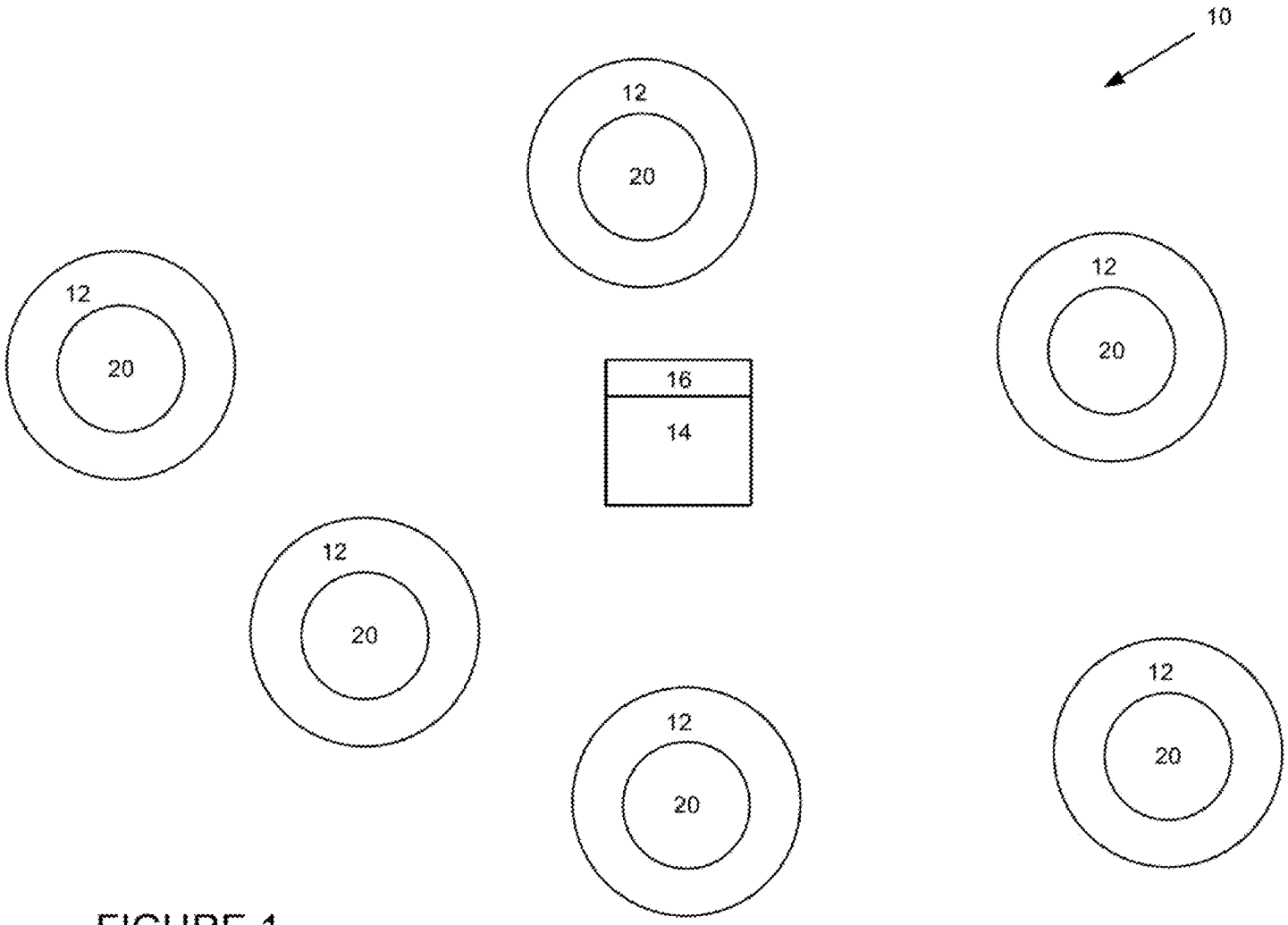
FIG. 1 is a schematic diagram of a system for use with a blank firing laser attachment (BFLA)

Turning to FIG. 1, a schematic diagram of a system in which a BFLA is used is shown. In the current system, the system 10 comprises a plurality of targets 12 along with at least one firearm 14 including a BFLA 16. As understood, the firearm 14 is associated with a user who is shooting at the targets 12 within the system 10. While appearing to be stationary, the targets 12 may also be an object in motion. For instance, if the user is shooting at other individuals, the targets 10 may be embedded within a vest that the individual is wearing. Each of the targets 10 includes a sensor 20 which senses if, or when, the target has been "hit" by the firearm 14. The targets 10 may include further components such as, but not limited to, an apparatus for communicating with the BFLA 16, an apparatus for making a noise and/or a central processing unit.

In operation, as will be described below, when a laser from the BFLA 16 hits a target 12, a signal may be generated by the target to indicate a successful shot. This signal may either be an audible sound or may be an electronic signal that is transmitted to a processor within the BFLA to indicate that the target has been hit.

Figure 2A:
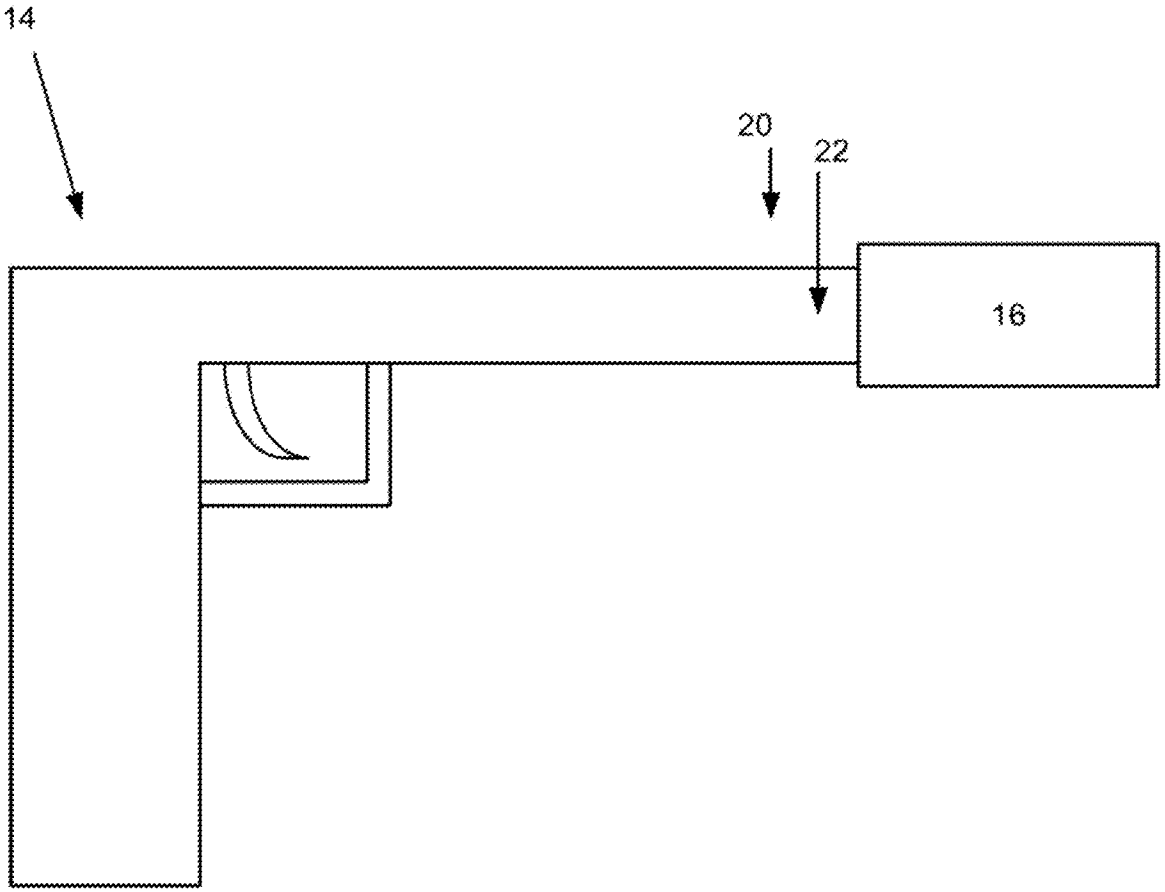
FIG. 2*a* is a schematic side view of a BLFA mounted to a firearm.
Figure 2B:
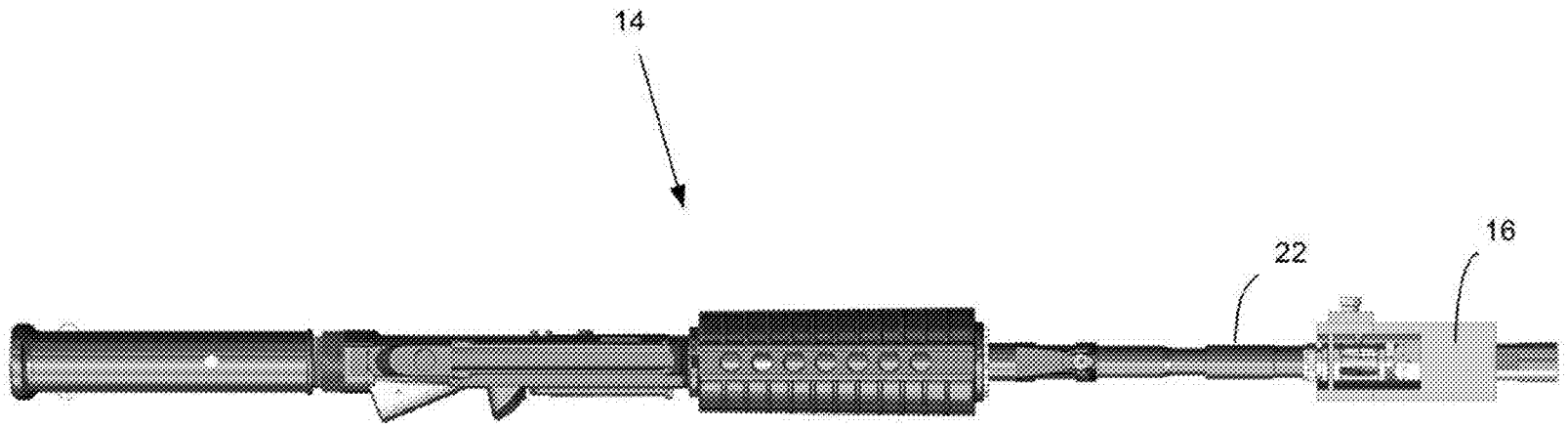
FIG. 2*b* is a top view of a BFLA mounted to a rifle.

Turning to FIG. 2*a*, a perspective view of a firearm is shown. A top view is shown in FIG. 2*b*. Prior to use, the user mounts the BFLA 16 to an end 20 of the firearm 14, such as a barrel housing 22. In one embodiment, the barrel housing 22 provides support for the BFLA 16 and includes apparatus for receiving the BFLA 16 (not shown) while the BFLA 16 includes apparatus for mounting the BFLA to the firearm 14 (as will be described below). The connection between the BFLA 16 and the barrel housing 22 may be via a threaded connection, however, the connection may also be via a socket-type connection. Other methods of mounting the BFLA 16 to the barrel housing 22 are also contemplated.

In a further embodiment, the apparatus for mounting the BFLA 16 to the firearm 14 is designed to fit a specific firearm, however, the apparatus for mounting may be designed to fit any number of weapons so that the BFLA 16 is more adaptable. Alternatively, the apparatus for mounting may be a one-size fits all type of mounting apparatus. It is preferred that the apparatus for mounting include a quick lock mechanism for facilitating the mounting and removal of the BFLA 16 from the firearm 14.

Figure 3:
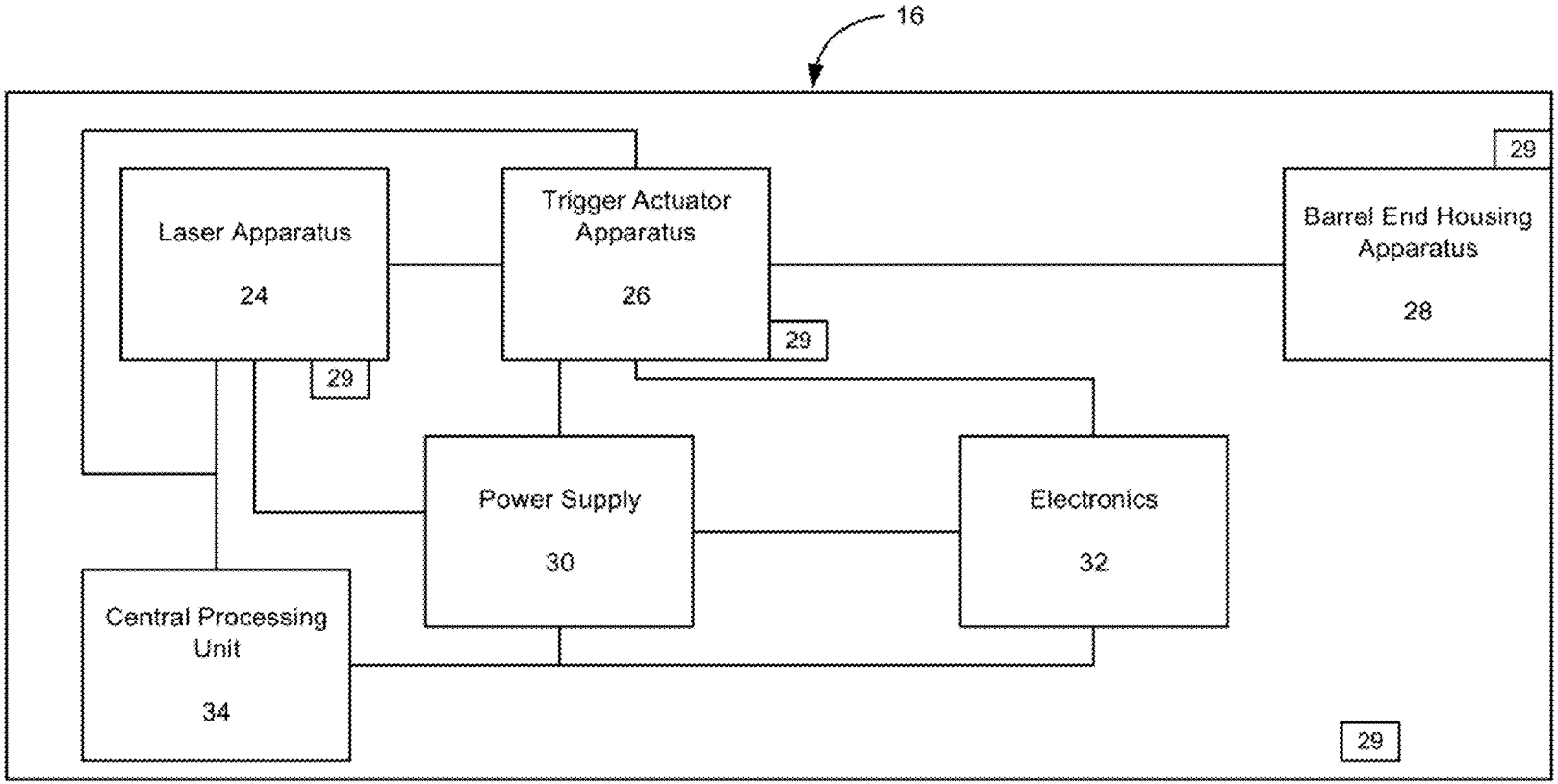
FIG. 3 is a schematic diagram of a BFLA.

Turning to FIG. 3, a schematic diagram of the BFLA is shown. The BFLA 16 includes a laser apparatus 24, a trigger actuator apparatus 26, a barrel end housing apparatus 28, a power supply 30 and an electronics portion 32. The BFLA 16 may also include a processor, seen as central processing unit 34, for transmitting and receiving signals to and from the various parts of the BFLA 16 relating to the operation of the BFLA. In another embodiment, the processor 34 may be integrated within the electronics portion 32. In order for the BFLA 16 to replicate a shot being fired, the laser apparatus 24 and the barrel end housing apparatus 28 are aligned with each other along an axis of the barrel of the firearm. In a preferred embodiment, the BFLA 16 takes into account the trajectory of the shot.

In the preferred embodiment, the BFLA 16 is meant to be an attachment which is mounted to the end of the firearm 14.

The BFLA 16 may further comprise a set of sensors 29 located throughout the BFLA for sensing conditions within the BFLA 16 to monitor the efficiency of the BFLA or the firearm to which it is attached. Alternatively, or along with monitoring the efficiency, the sensors 29 may sense the temperature within the firearm 14 or BFLA 16, the power level of the power supply or the efficiency of the laser apparatus. In another embodiment, sensors, such as an accelerometer or gyroscope, may be used to provide information to the user regarding their use of the firearm by providing feedback with respect to recoil after a shot or steadiness of the user's aim. Other measurements relating to operation of the BFLA 16 or the firearm 14 may also be sensed by the set of sensors 29.

Figure 4:
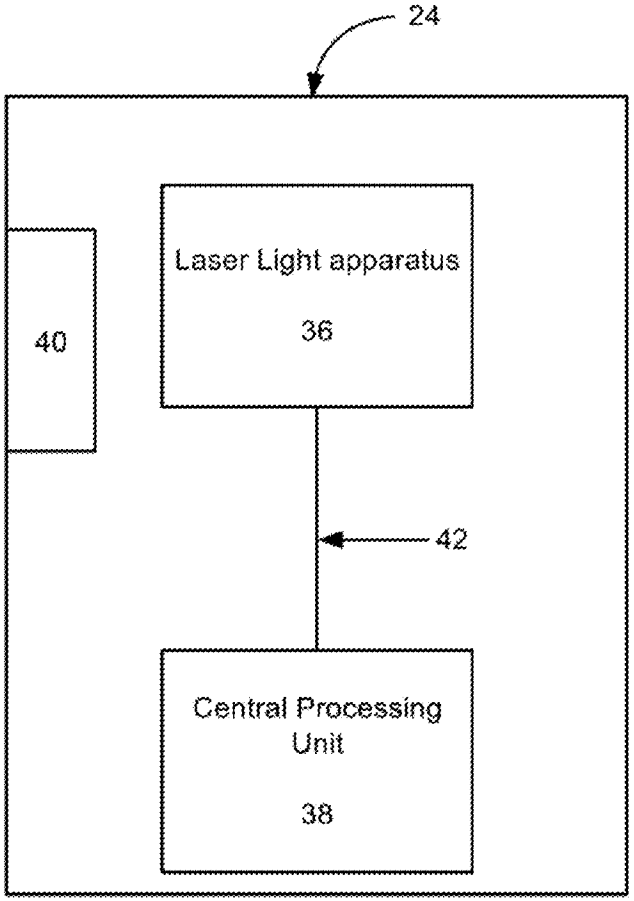
FIG. 4 is a schematic diagram of a laser apparatus of the BFLA.

As shown in FIG. 4, which is a schematic diagram of the laser apparatus 24, the laser apparatus 24 includes a laser light portion 36 which operates at a specified wavelength. This laser light portion 36 may be replaced in order to change the wavelength when required. Depending on the type of laser light portion 36, the wavelength may also be changed via user input which is processed by the processor. If necessary, the laser apparatus 24 may further include a processing unit 38 which is in communication with the processor 34, however, this processing unit 38 may be the processor itself. For the current description, it is assumed that the BFLA 16 is controlled by the processor 34. The processor 34 controls the laser light portion 36 to adjust the laser light based on the direction that the firearm is facing as decided by the user and sensed by the sensors 29. The laser apparatus 24 may further include a threaded front aperture 40 which may support a debris window or a collimating lens. The laser apparatus 24 is preferably moisture proof and includes a set of control wires 42 for communication between the processor 34 and the laser light apparatus or portion 36.

Figure 5:
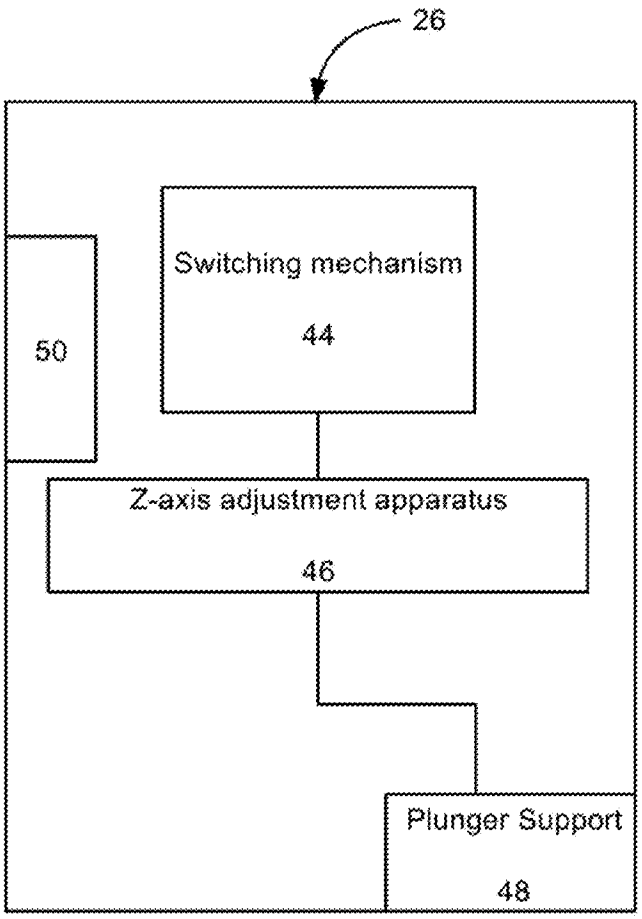
FIG. 5 is a schematic diagram of a trigger actuator apparatus of the BFLA.

FIG. 5 is a schematic diagram of one embodiment of the trigger actuator apparatus. The trigger actuator apparatus 26 comprises a switching mechanism 44 which may either be a micro switch, a pressure switch or the like. When a blank cartridge is fired, a hot gas discharge occurs whereby pressure from the hot gas discharged is sensed by the switching mechanism 44 (or sensors 29) thereby causing a signal to be transmitted to the processor 34 to activate or initiate the laser light portion 36. The trigger actuation module 14 may further include a Z-axis adjustment apparatus 46 along with an actuator plunger support 48. In one embodiment, the trigger actuator apparatus 26 includes a separation area 50 for the hot gases which may be produced during operation of the BFLA 16 or the firearm 14. Communication between the switching mechanism 44 and the processor 34 is preferably via a set of control wires, however, the communication may also be wireless.

Figure 6:
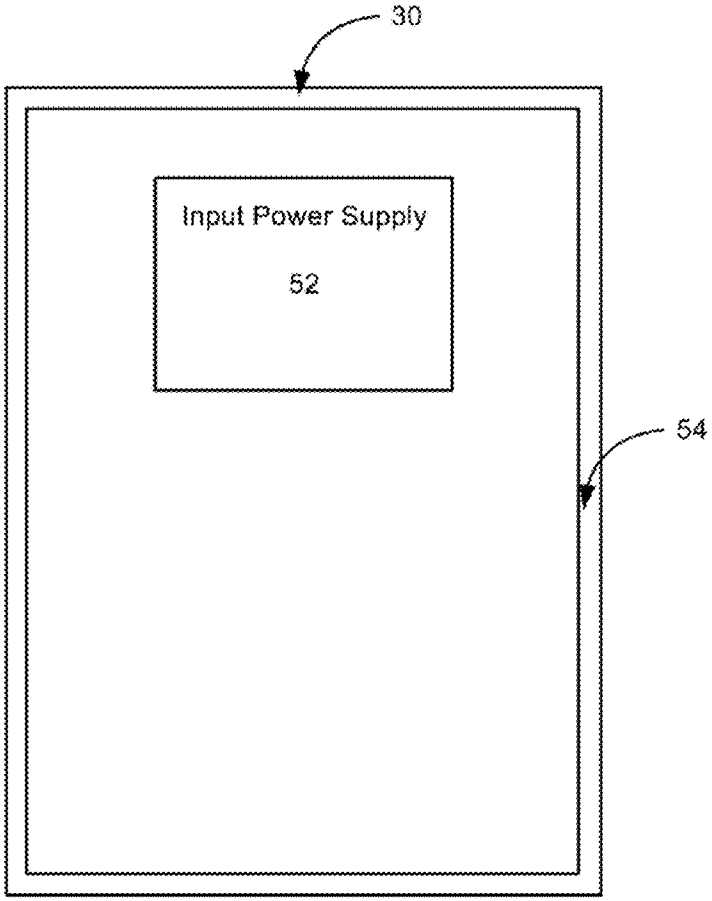
FIG. 6 is a schematic diagram of a power supply of the BFLA.

Turning to FIG. 6, a schematic diagram of the power supply is shown. The power supply 30 includes an input power supply 52 which may either be a lithium ion battery, a rechargeable circuit, a standard 9V battery, a CR123 battery or the like. Other input power supplies such as, but not limited to, traditional AC power outlets, solar cells, piezoelectric generators, kinetic electricity generators, or the like are also contemplated. As shown in FIG. 3, the power supply 30 is preferably connected to each of the other parts of the BFLA 16 which require power to operate and is preferably located in an area within the BFLA 16 where it may be easily accessed so that replacement is facilitated. For instance, the power supply 30 may be physically located at a bottom of the BFLA 16 so that it may be easily replaced. The power supply 30 preferably includes a moisture barrier 54 to protect the components from exposure to moisture in order to protect the user from electrocution or other possible injury.

Figure 7:
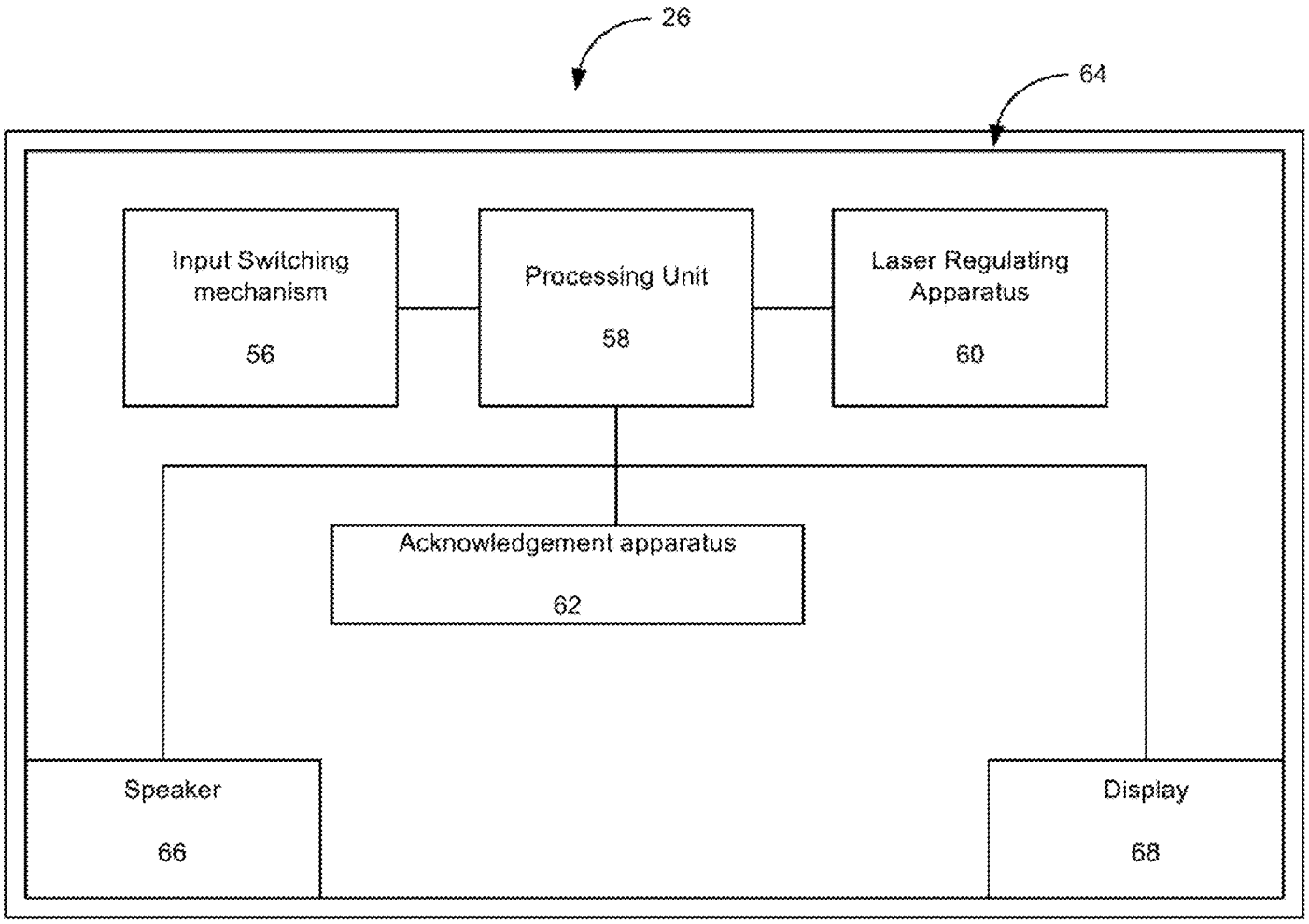
FIG. 7 is a schematic diagram of the electronics of the BFLA.

Turning to FIG. 7, a schematic diagram of the electronics section, or module is shown. As is understood, there may be other aspects of the electronics that are not disclosed, however they would be understood by one skilled in the art. The electronics module 32 comprises an input switch mechanism signal 56, a processor module 58, a laser regulating apparatus 60, apparatus for indicating a sensor acknowledgement signal 62 and a moisture barrier 64 for protecting the module 32. The laser regulating apparatus 60 may be used for modulating the laser and may also produce an identification signal for the laser (as will be discussed below).

In certain embodiments, the identification signal is accomplished by using the laser regulating apparatus 60 to pulsate the output from the laser apparatus 24 therefore producing a distinct laser output. This identification signal can then be used to identify the user which has hit target when in a system having multiple firearms or users.

For example, in use, when a target is hit, the sensor 20 which is associated with a target 12, may determine the identification signal after the sensor has been hit by processing the laser output which hit the target 12. For instance, laser output which hits the target may be processed to determine characteristics, such as but not limited to, its wavelength or its pulse length. After determining the laser output characteristics, the user/firearm/BFLA associated with the laser output characteristics may be determined such as by checking a database. The target 12 (via a processor or communication apparatus) can then transmit this determination or identification, such as via wireless communications, to the associated BFLA such that the user associated with this firearm will know that they hit the target 12.

In one embodiment, the electronic module 32 may include elements to transmit information, in the form of messages, to the user of BFLA operational conditions. These elements may include, but are not limited to, a speaker 66 or a display 68 (such as a liquid crystal display (LCD)) to provide audible or visual signals or messages. These messages may include, but are not limited to, informing the user whether or not the target has been hit, informing the user which target was hit, informing the user of accuracy or other statistics, or indicating any errors or malfunctions of the firearm or the BFLA. Although not shown, the electronic module 32 may itself include a central processing unit or may be controlled by the processor 34.

In use, a signal from the input switch mechanism 56 may be used to turn on the BFLA 16 in order to activate the trigger actuator apparatus 26. In order words, the input switch mechanism 56 senses the supply of power from the power supply 30 and activates the trigger actuator apparatus 26. Once on, the trigger actuator 26 may then wait to determine when the trigger of the firearm has been pulled. The laser regulation apparatus 60 is used to control or determine the characteristics of the laser that is to be used or delivered by the laser apparatus 24 as controlled by the processor or central processing unit 34 when a shot is required.

Figure 8:
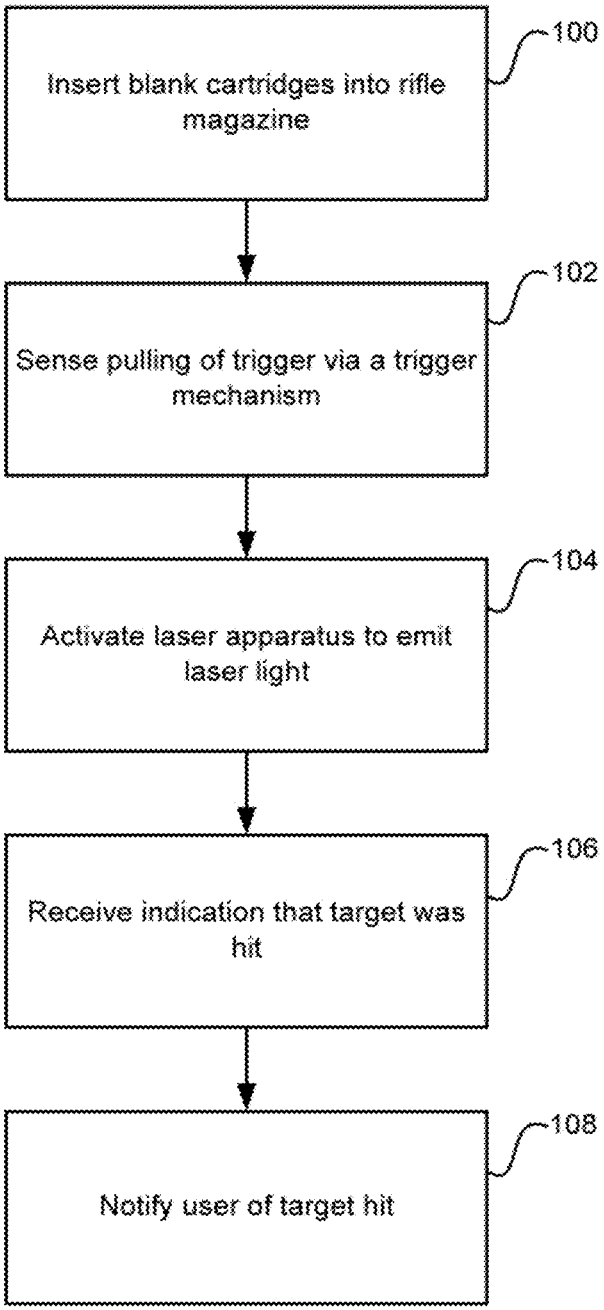
FIG. 8 is a flowchart outlining a method of use of the BFLA.

Turning to FIG. 8, a flowchart outlining a method of using a BFLA with a firearm is shown. In the current flowchart, the method is directed for use with a rifle although it will be understood that similar steps are performed when the BFLA is used with other types of firearms, such as, but not limited to, pistols, machine guns and shotguns.

In the current example, it is assumed that the BFLA has already been mounted to the end of the rifle and turned on whereby the input switching mechanism has transmitted a signal to the processor to activate the trigger actuator apparatus 26. In order to prepare the rifle for use with the BFLA, blank cartridges are inserted 100 into the rifle magazine. The blank cartridge may be, for example, a 0.223 blank cartridge and/or a 5.56 blank cartridge, depending on the requirements of the rifle. The presence of the blank cartridge allows operation of the rifle to be mimicked as if there was live ammunition sitting within the rifle chamber as delivered by the rifle magazine. As will be understood, the insertion of the blank cartridges is not necessarily part of the use of the BFLA but is required to prime or prepare the rifle for use in a shooting scenario.

When in use, if the user spots a target, in order to take a shot at the target, the user squeezes the trigger of the firearm. After being activated by the input switch mechanism, the trigger actuator apparatus continually senses 102 when the firearm trigger is pulled thereby releasing of the firing pin within the rifle. The releasing of the firing pin causes the firing pin to hit the primer of the blank cartridge in the rifle chamber. Typically, gun powder within the blank cartridge is ignited by the primer creating pressure within the barrel of the rifle causing hot gases to discharge and travel up the barrel. This hot gas may be separated in the separation area of the trigger actuator apparatus.

The pressure created within the barrel via the pulling of the trigger causes a pin, such as a switch actuation pin, to compress the input switch mechanism located in the BFLA. At the same time, this pressure also activates a gas piston that reloads the chamber with a new blank cartridge from the blank cartridges in the rifle magazine. Therefore, in a preferred embodiment, both the gas piston and the switch actuation pin are activated by the pressure created from the ignition of the gun powder when the trigger is pulled.

After the input switch mechanism is compressed, the processor triggers the laser light portion to emit 104 a laser light at a specific wavelength and specific pulse. In other words, the pulling of the trigger causes the laser light portion within the laser apparatus to emit a pulse to replicate a shot being fired. In certain embodiments, the laser is pulsed to define laser characteristics which will assist in identifying the user which hits the target.

If the laser hits a target, a signal may be generated indicating a successful shot. This signal may be an audible signal associated with the target which has been hit. In another embodiment, the target (or a processor associated with the target) transmits a signal or message which is received 106 by the processor associated with the BFLA which hit the target indicating that a shot from the associated BFLA hit the target. This message may then be communicated 108 to the user via an audible sound or a display message.

Figure 9:
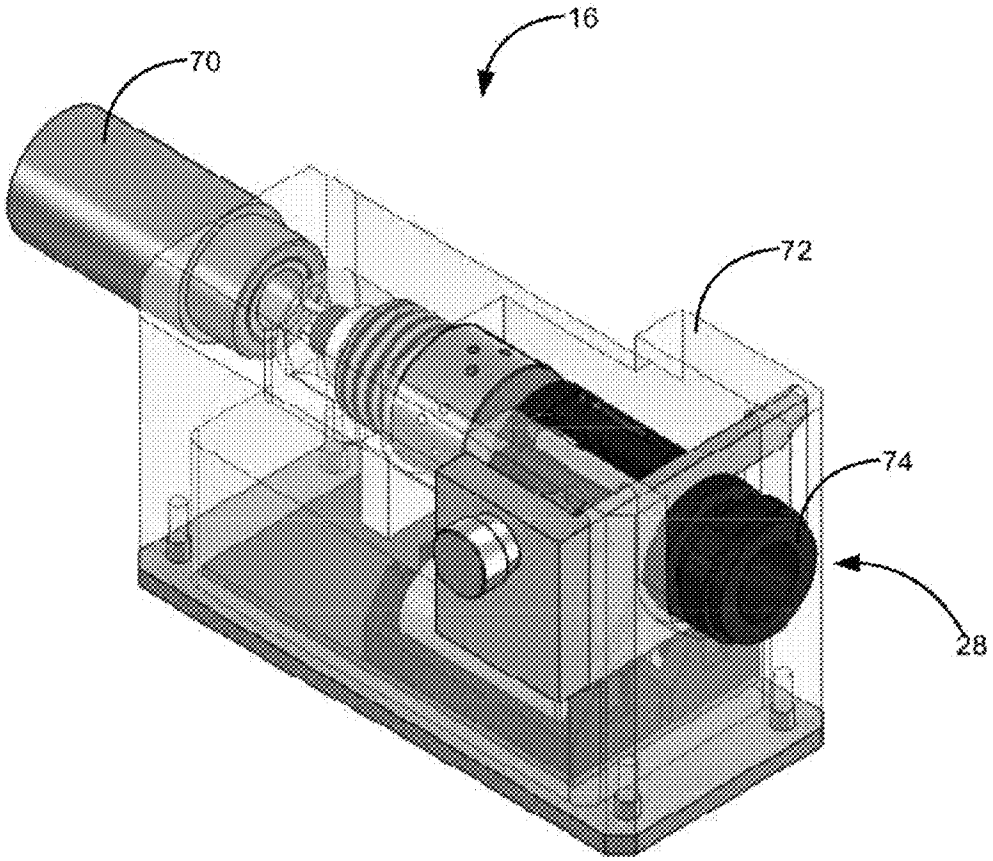
FIG. 9 is a perspective view of an embodiment of the BFLA.

Turning to FIG. 9, a perspective view of an embodiment of a BFLA is shown. The BFLA 16 includes a barrel end housing mating portion 70 (or apparatus for mounting) which is used to connect the BFLA 16 to the end of the firearm (not shown). The mating portion 70 includes a portion, such as, but not limited to, a threaded portion or a male plug portion which corresponds with a matching threaded portion or female receiving portion on the end of the firearm. The BFLA 16 further includes a housing 72 which houses each of the parts of the BFLA as disclosed above with respect to FIG. 3. While shown as being transparent in FIG. 9 for description purposes, the housing 72 is preferably opaque so that the inside of the BFLA can not be seen. In a preferred embodiment, the housing 72 is preferably manufactured from a lightweight material which is solid in colour.

The BFLA 16 further includes an exit portion 74 which is located opposite the barrel end housing mating portion 70 and is in axial alignment with the barrel housing mating portion 70 such that when the user pulls the trigger, the pressure within the firearm activates the laser apparatus to transmit a laser beam through the exit portion 74 towards the target. The exit portion 74 may be part of the barrel housing apparatus 28. The alignment allows the laser to be delivered directly at the target without being deflected or blocked by parts within the BFLA 16.

In a preferred embodiment, the weight of the BFLA 16 is kept down so as to not affect the individual's experience with the firearm such that repeated uses of the firearm improves the individual's accuracy with the firearm without introducing external factors to the experience.

Figure 10:
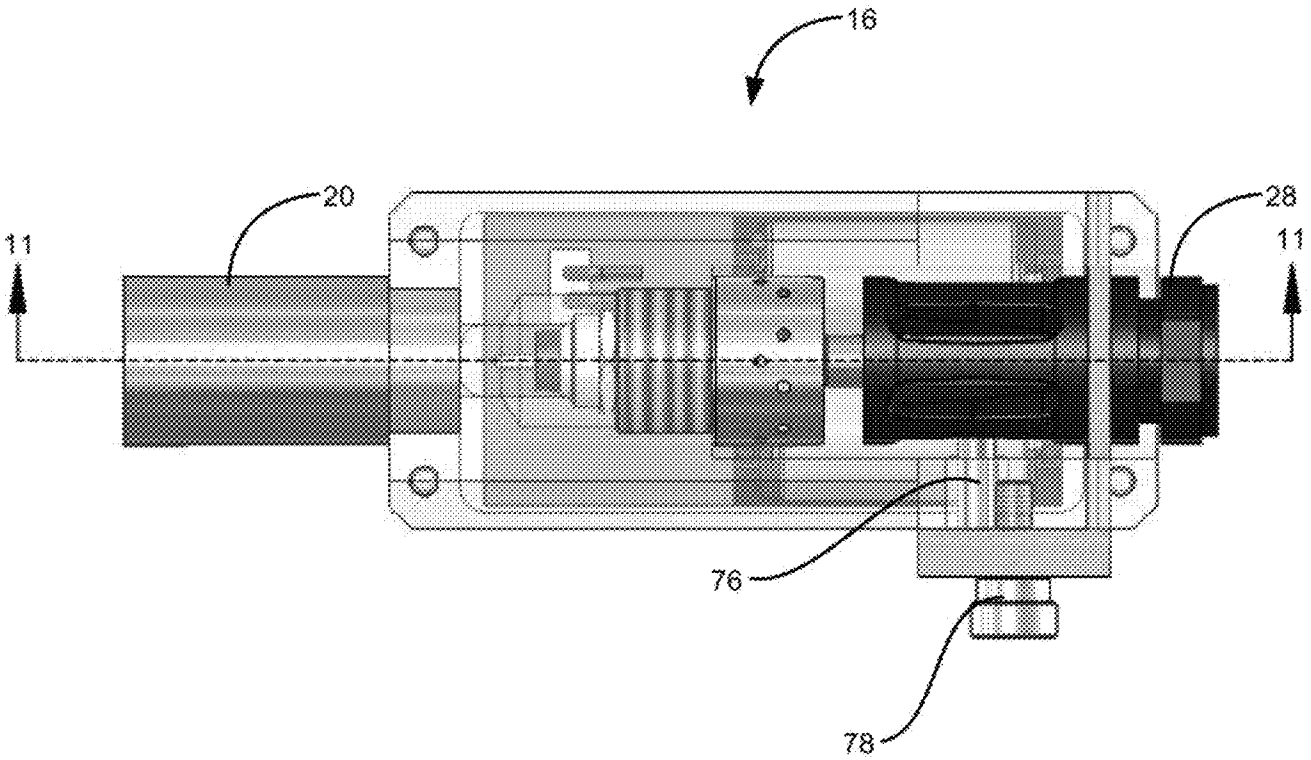
FIG. 10 is atop view of the BFLA of FIG. 9.

Turning to FIG. 10, a top view of one embodiment of a BFLA is shown. As can be seen in FIG. 10, the BFLA 16 includes an alignment pin 76 for alignment of the barrel housing apparatus 28 of the BFLA 16. A thumb screw 78 may also be used for tightening the alignment pin 76 within the BFLA 16. As discussed above, the BFLA 16 should be in axial alignment with the opening of the barrel of the firearm.

Figure 11:
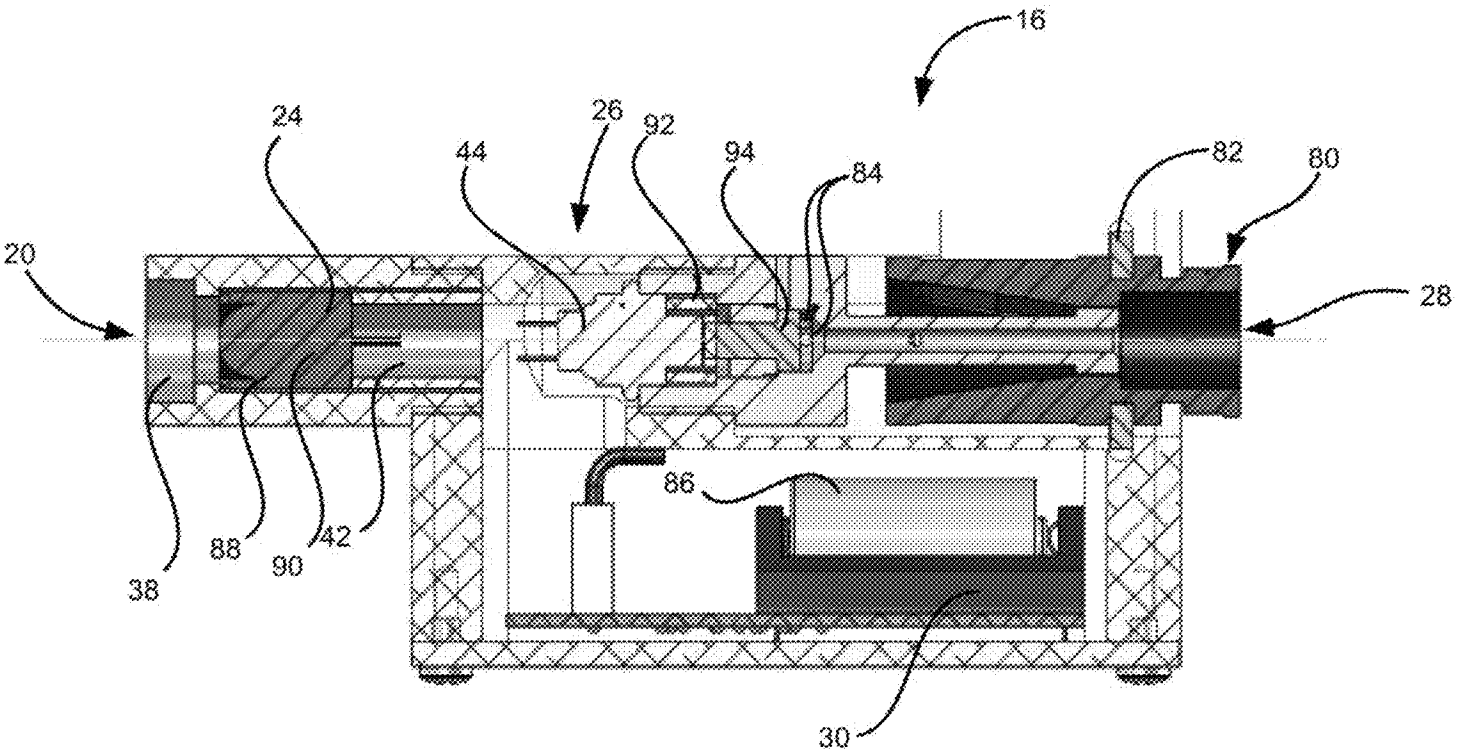
FIG. 11 is a cross-section view, taken along line 10-10 of FIG. 9.

Turning to FIG. 11, which is a cross-section taken along line 11-11 of FIG. 10, the barrel housing apparatus 28 may include a flash suppressor 80 located at one end. A retaining clip 82 is used to assist in holding the barrel housing apparatus 28 in place. The BFLA 16 may further include a pair of exhaust ports 84 which allow exhaust gases within the firearm to escape once the trigger has been pulled in order to reduce the pressure within the BFLA 16. In the current embodiment, within the barrel end apparatus housing 28, there may be a debris lens cavity.

As shown, the power supply 30 includes a battery 86 which supplies the power to the components within the BFLA 16. The laser apparatus 24 may include a diode housing 88 and a diode sleeve 90 which protects the laser and the trigger actuator apparatus 26 includes the switching mechanism 44 which is connected with a switch depth control sleeve 92 and a switch actuation pin 94.

In the preceding description, for purposes of explanation, numerous details are set forth in order to provide a thorough understanding of the embodiments of the disclosure. However, it will be apparent to one skilled in the art that some or all of these specific details may not be required in order to practice the disclosure. In other instances, well-known electrical structures and circuits are shown in block diagram form in order not to obscure the disclosure. For example, specific details are not provided as to whether the embodiments of the disclosure described herein are as a software routine, hardware circuit, firmware, or a combination thereof.

The above-described embodiments of the disclosure are intended to be examples only. Alterations, modifications and variations can be effected to the particular embodiments by those of skill in the art without departing from the scope of the disclosure, which is defined solely by the claims appended hereto.

What is claimed is:

1. A blank firing laser attachment apparatus for use with a firearm comprising:

a laser module for producing a laser output, wherein the laser output is configured to be in axial alignment with a barrel housing of the firearm when the blank firing laser attachment is mounted to the firearm;

a trigger actuation module including a switching mechanism for sensing a gas discharge when a blank cartridge has been discharged by a pulling of a trigger of the firearm;

an electronic module for modulating the laser output;

a set of sensors for sensing conditions within the blank firing laser attachment apparatus;

a processor for activating and controlling the laser output based on a signal from the trigger actuation module; and a barrel end housing module for mounting the blank firing laser attachment apparatus to the barrel housing;

wherein the switching mechanism is a micro switch or a pressure switch.

2. The blank firing laser attachment apparatus of claim 1 further comprising at least one exhaust port for allowing exhaust gases to escape.

3. The blank firing laser attachment apparatus of claim 1 wherein the switching mechanism is pressure activated.

4. The blank firing laser attachment apparatus of claim 1 wherein the barrel end housing module comprises an alignment pin for aligning the blank firing laser attachment apparatus with the barrel housing.

5. The blank firing laser attachment apparatus of claim 1 wherein the barrel end housing module comprises a flash suppressor.

6. The blank firing laser attachment apparatus of claim 1 wherein the trigger actuation module comprises a separation area for the gas discharge.

7. The blank firing laser attachment apparatus of claim 1 wherein the electronic module modulates the laser output by pulsating the laser output.

8. The blank firing laser attachment apparatus of claim 7 wherein the modulated laser output contains identification information.

9. The blank firing laser attachment apparatus of claim 8 wherein a sensor demodulates the laser output to obtain the identification information.

10. The blank firing laser attachment apparatus of claim 1 wherein the electronic module comprises a notification element.

11. The blank firing laser attachment apparatus of claim 1 wherein the processor controls a wavelength of the laser output based on user input.

* * * * *